US010041342B2

(12) United States Patent
Gu

(10) Patent No.: US 10,041,342 B2
(45) Date of Patent: Aug. 7, 2018

(54) AUTOMATIC STAGE DESIGN OF HYDRAULIC FRACTURE TREATMENTS USING FRACTURE HEIGHT AND IN-SITU STRESS

(75) Inventor: Hongren Gu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/084,893

(22) Filed: Apr. 12, 2011

(65) Prior Publication Data

US 2011/0247824 A1 Oct. 13, 2011

Related U.S. Application Data

(60) Provisional application No. 61/323,058, filed on Apr. 12, 2010.

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/267; E21B 34/14
See application file for complete search history.

(56) References Cited

U.S. PATENT DOCUMENTS 4,718,490 A 1/1988 Uhri
4,879,654 A 11/1989 Bruce
5,111,861 A 5/1992 Soliman et al.
5,228,510 A 7/1993 Jennings, Jr. et al.
6,283,214 B1 9/2001 Guinot et al.
6,412,559 B1 7/2002 Gunter et al.
6,766,254 B1 7/2004 Bradford et al.
6,860,147 B2 3/2005 Gunter et al.
6,991,032 B2 * 1/2006 Berchenko et al. ..... 166/245
7,042,802 B2 * 5/2006 Sinha ..... 367/86
(Continued)

OTHER PUBLICATIONS

SPE115304—Development of a Calibrated Fracture-Growth Model and Automated Staging Routine for the Jonah Field. Copyright 2009, Society of Petroleum Engineers. Presented at the 2009 SPE Rocky Mounting Petroleum Technology Conference held in Denver, Colorado, USA, Apr. 14-16, 2009.
(Continued)

*Primary Examiner* — Silvana C Runyan
(74) *Attorney, Agent, or Firm* — Michael L. Flynn

(57) ABSTRACT

A method for treating a subterranean formation comprising measuring mechanical properties of a formation comprising Young's modulus, Poisson's ratio, and in-situ stress; determining formation fracture height based on the mechanical properties; estimating number and location of hydraulic fractures based on the determining; identifying hydraulic fracturing treatment stages based on the estimating; and performing hydraulic fracturing treatments in the stages. A method for treating a subterranean formation comprising measuring mechanical properties of a formation comprising Young's modulus, Poisson's ratio, and in-situ stress; determining a target zone based on the mechanical properties; estimating number and location of hydraulic fractures based on the determining; identifying hydraulic fracturing treatment stages based on the estimating; and performing hydraulic fracturing treatments in the stages.

20 Claims, 5 Drawing Sheets

(56) References Cited

U.S. PATENT DOCUMENTS

| | | | | |
|---|---|---|---|---|
| 7,126,340 | B1 | 10/2006 | Ameen et al. | |
| 7,386,431 | B2 | 6/2008 | Siebrits et al. | |
| 8,412,500 | B2 | 4/2013 | Weng et al. | |
| 2003/0050758 | A1* | 3/2003 | Soliman | E21B 43/26 702/6 |
| 2005/0125209 | A1 | 6/2005 | Adams et al. | |
| 2006/0224370 | A1 | 10/2006 | Siebrits et al. | |
| 2007/0272407 | A1* | 11/2007 | Lehman et al. | 166/250.1 |
| 2008/0183451 | A1 | 7/2008 | Weng et al. | |
| 2010/0006293 | A1 | 1/2010 | Gu et al. | |
| 2011/0017458 | A1* | 1/2011 | East et al. | 166/308.1 |
| 2011/0198088 | A1* | 8/2011 | Caro et al. | 166/308.1 |

OTHER PUBLICATIONS

Davis, R.J., "Use of Log-Derived parameters for completion design enhancement in the medina formation," SPE Eastern Regional Meeting, No. 17035, Oct. 21-23, 1987, Pittsburgh, Pennsylvania, 2 pages.

International Preliminary Report on Patentability for International Patent Application No. PCT/IB2011/051589 issued on Oct. 23, 2012, 7 pages.

Xinmin Yi et al.,Translation "Estimating and determining hydraulic fracture height based on logging information," Journal of Southwest Petroleum University, vol. 31, issue. 5, pp. 21-24.

Mexican Office Action Dated Dec. 3, 2014, for Mexican Patent Application No. MX/a/2012/011722.

Extended Search Report issued in related EP application 15171052.2 dated Oct. 9, 2015, 8 pages.

* cited by examiner

AUTOMATIC STAGE DESIGN OF HYDRAULIC FRACTURE TREATMENTS USING FRACTURE HEIGHT AND IN-SITU STRESS

PRIORITY CLAIM

Field

Embodiments of this application relate to methods and apparatus to model fractures in subterranean formations and to treat the formations using information from the models.

BACKGROUND

In tight gas formations, hydraulic fracturing treatments are often carried out in multiple stages when there are many gas bearing formation layers (payzones) over a large depth interval in a well. The minimum horizontal in-situ stress has a strong effect on hydraulic fracture height, and the hydraulic fracture height is an important factor to consider in designing the treatments. It is time consuming to manually design staged hydraulic fracturing treatments in tight gas formations when the number of payzones is large (over 100). The design of fracturing treatments depends on many factors, such as petrophysical and geomechanical properties of the formation. Algorithms are available for staging design based on petrophysical properties, but the in-situ stresses have not been considered in such algorithms. The minimum horizontal in-situ stress has a strong effect on hydraulic fracture height (FIG. 1 Prior Art), and the hydraulic fracture height is an important factor to consider in designing the treatments. The fracture height may determine how many pay zones are stimulated by one fracture, and how many fractures are grouped into one stage. The design objective is to have all pay zones stimulated by a number of hydraulic fractures, and to have no or minimal overlapping of fracture heights. Each fracture height can be estimated from a fracture height model and minimum horizontal in-situ stress distribution versus depth. It is desirable to automatically design such staged treatments using a computer program that takes into account in-situ stress and fracture height.

FIGURES

SUMMARY

Figure 1:
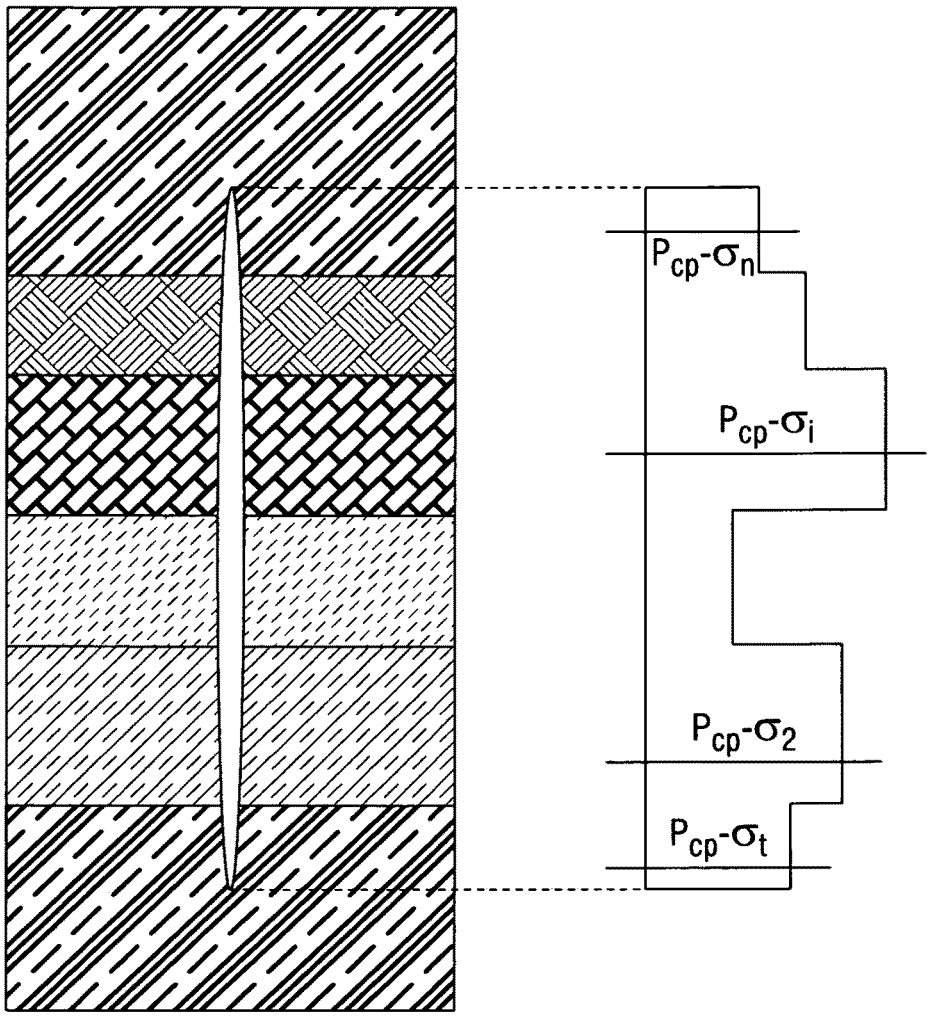
FIG. 1 (Prior Art)
FIG. 1 (Prior Art) is a sectional view of a vertical fracture in a layered formation.

Embodiments of the invention relate to a method for treating a subterranean formation comprising measuring mechanical properties of a formation comprising Young's modulus, Poisson's ratio, and in-situ stress; determining formation fracture height based on the mechanical properties; estimating number and location of hydraulic fractures based on the determining; identifying hydraulic fracturing treatment stages based on the estimating; and performing hydraulic fracturing treatments in the stages. Embodiments of the invention also relate to a method for treating a subterranean formation comprising measuring mechanical properties of a formation comprising Young's modulus, Poisson's ratio, and in-situ stress; determining a target zone based on the mechanical properties; estimating number and location of hydraulic fractures based on the determining; identifying hydraulic fracturing treatment stages based on the estimating; and performing hydraulic fracturing treatments in the stages.

DESCRIPTION

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range. The statements made herein merely provide information related to the present disclosure and may not constitute prior art, and may describe some embodiments illustrating the invention.

Embodiments of this invention include a method for automatically designing multi-stage hydraulic fracturing treatments in multi-payzone formations based on the minimum horizontal in-situ stress. A method was developed to select the number and locations of hydraulic fractures required to stimulate all payzones, and at the same time, with no or minimal overlapping of fractures. The hydraulic fractures are then grouped together based on available pumping capacity for each treatment stage to determine the number of stages required to treat the entire well.

The method is applicable for vertical or slightly deviated wells in tight gas formations. For such formations, long fractures are required to achieve a production increase. The tight gas formations often consist of shale and sandstone sequences, and the gas production is mainly from the sandstone layers. The applicability of the method depends on stress contrasts to limit fracture heights to practical magnitude. When there is no stress contrast large enough to limit fracture height growth, other rules are required for the treatment stage design.

As briefly discussed above and illustrated by FIG. 1 (Prior Art), stress contrasts between formation layers may form barriers to contain fracture height growth. Depending on the rock properties and the fracture treating pressure, the effectiveness of stress barriers depends on the magnitude of the stress contrast and the thickness of the stress layers (FIG. 1 Prior Art). In order to determine the vertical coverage of hydraulic fractures over multiple layers, we need to know whether the stress in one or more layers is large enough for form a barrier to height growth. Both the magnitude of the stress and the thickness of the layers affect the growth of the fracture in the vertical direction. It is difficult to use empirical rules to determine quantitatively whether a stress contrast is an effective barrier. On the other hand, a P3D (Pseudo 3D) or Planar 3D hydraulic fracture simulator can be used to determine fracture height growth and whether stress contrasts can limit the fracture height. However, a full P3D or Planar 3D simulation requires detailed treatment design including fluid properties and a pump schedule. A best practice using an embodiment of the invention provides a fast and quantitative estimate of fracture height coverage without running full hydraulic fracture simulations.

Embodiments of this invention relate to methods to automatically design staged hydraulic fracturing treatments based on fracture height and in-situ stress. A method was developed to select the number and locations of hydraulic fractures required to stimulate all payzones, with no or minimal overlapping of fractures. The hydraulic fractures are then grouped together based on available pumping capacity for each treatment stage to determine the number of stages required to treat the entire well. The detailed step-by-step method, which takes into account the effect of in-situ stress and fracture height in staging design, is described below.

1. Formation Zones

Figure 2:
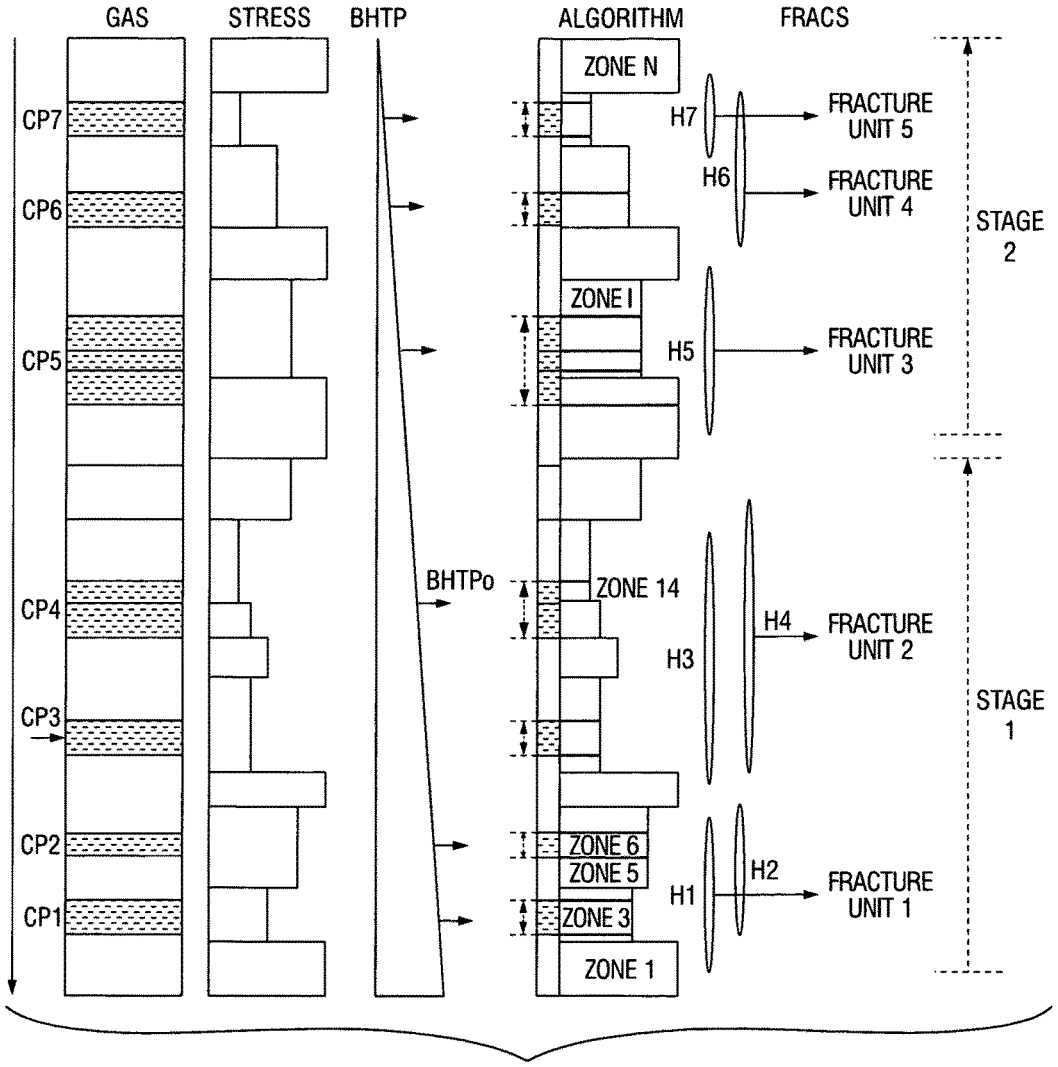
FIG. 2 is a representative view of stage determination using stress and algorithm refinements.

It is assumed that the zones of petrophysical properties, mechanical properties, and in-situ stresses are generated from well logs. Each zone has a single value of any property, and a zone is the smallest unit in the staging design algorithm. For example, zones based on petrophysical properties (gas payzones) and based on stresses are shown under the headings of Gas and Stress in FIG. 2. In addition, several payzones of different petrophysical properties may exist next to each other. It is convenient to group these payzones together in one unit, and define it as a Contiguous Payzone (CP). A CP may have one or more payzones. In FIG. 2, the contiguous payzones are marked by a red fill pattern and numbered as CP1-CP7. Since zones of petrophysical properties and stresses are determined from different logs, they are likely to have zone boundaries at different depths. In order to apply the algorithm, these zones need to be combined so that each zone has one value of any property. An example of combined zones is shown in FIG. 2 under the heading of "GAS."

2. Bottomhole Treating Pressure

The bottomhole treating pressure (BHTP) can be determined or estimated from previous treatments in offset wells in the same or similar formations. If a BHTP at a particular depth (TVD) is known, the BHTP as a function of depth can be obtained by using a pressure gradient. One estimate of the pressure gradient is the averaged value of the stress gradients of all CPs. Multiple BHTPs at multiple depths can also be specified, in which case the BHTP as a function of depth is provided by a table of BHTP versus depth. In FIG. 2, the known BHTP at one depth is shown by $BHTP_0$ and the BHTP as the function of TVD is shown under the heading of BHTP.

3. Fracture Initiation Intervals

A fracture initiation interval is required in each simulation using a software program such as the program FRACHITE™ which is commercially available from Schlumberger Technology Corporation of Sugar Land, Tex. to determine fracture height. We need to determine the locations where the fractures initiate along the TVD of the entire formation. Generally, a fracture initiation interval is a CP, for example, the intervals are shown by double arrows and numbered with I1, I2, I3, I8, and I9, one for each CP in FIG. 2. However, when there are different stresses in a CP, a number of fracture initiation intervals are needed so that each interval has one value of stress. For the example in FIG. 2, CP4 has two initiation intervals I4 and I5, and CP5 has two initiation intervals of I6 and I7. In total, there are nine fracture initiation intervals in FIG. 2. The equations for an algorithm that may benefit the software may be obtained from historical mathematical model textbooks. For example, Reservoir Stimulation, 3rd Edition, by Michael Economides and Kenneth Nolte, (2000) Chapter 6, pages 6-16 to 6-18 including equations 6-47 to 6-50 provide effective equations and are incorporated by reference herein.

4. Software

The software program FRACHITE™ is used to calculate a fracture height H for each fracture initiation interval based on formation mechanical properties, stresses, and BHTP. The BHTP at the depth of each initiation interval for the FRACHITE™ calculation is interpolated from the BHTP versus depth function. The results from the FRACHITE™ calculations are the fracture heights from all the initiation intervals, each height is associated with one initiation interval, as shown by H1-H9 from I1-I9 under the heading "Heights" in FIG. 2. The results of this step show which stress barriers are strong enough to limit fracture height growth, and which stress barriers are not effective in containing fracture height growth. This provides a quantitative determination of fracture coverage in the vertical direction. It is important to note that the heights H are used to determine the effectiveness of stress barriers and they may not be the actual fracture heights in the full hydraulic fracture simulations or in the final treatment design.

5. Fractures

Figure 3A:
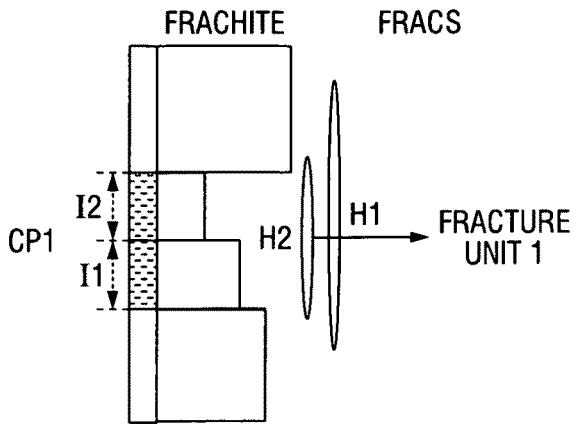
FIG. 3 is a representative view of stress difference in a payzone: (*a*) one fracture needed; (*b*) two fractures needed.
Figure 3B:
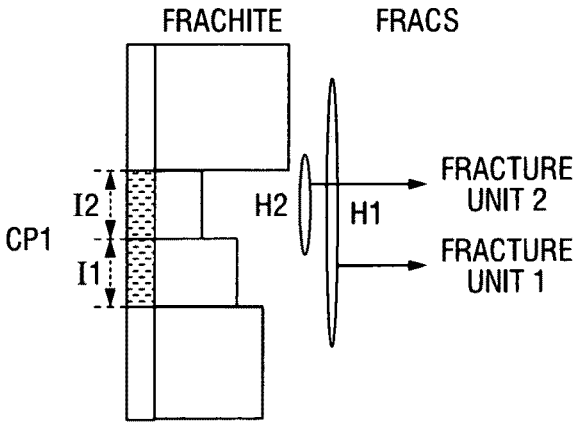

Because the heights determined in Step 4 may overlap, a number of CPs may be treated or stimulated by one fracture. We need to determine the minimum number of fractures that are needed to treat all the CPs, with no or minimal overlapping. This step is the procedure to determine fractures based on the heights obtained from Step 4 by the following rules:

a. When the stress barriers are effective, a height is contained by surrounding layers, i.e., there is no overlapping among fracture heights from different initiation intervals. In this case, use one height as the fracture for one CP. For example, one fracture (Fracture unit 2) is associated with the contained height H3, and this fracture is used to treat CP3 (FIG. 2).

b. When the stress barriers are not strong enough, two or more heights may overlap. We consider two heights overlapping here. For two heights from two fracture initiation intervals of different stresses, two possibilities exist:

b1) If the height from the initiation interval of low stress covers the interval of high stress, designate one fracture for this height and use this fracture to treat the two CPs associated with the two intervals. For the example in FIG. 2, the height H1 from the low stress interval I1 covers the high stress interval I2 and the associated CP2. We use one fracture unit 1 to treat both CP1 and CP2.

b2) If the height from the lower stress initiation interval does not cover the high stress interval, use two fractures (Fracture units), i.e., one for each height, to treat the two CPs associated with these two intervals. For example, the height H9 from the initiation interval I9 does not cover the initiation interval I8. We use two fractures, Fracture unit 5 and Fracture unit 6, for the two initiation intervals I8 and I9, respectively. Each fracture is to treat one CP associated with its initiation interval (Fracture unit 5 for CP6, and Fracture unit 6 for CP7).

c. When there are stress differences inside a CP, multiple initiation intervals are used and the fractures from these initiation intervals are likely to overlap. We consider the case of two fracture initiation intervals inside a CP as an example (FIG. 3). The two heights associated with the two intervals will generally have some overlap since they are inside one CP. The height initiated from the high stress interval will always grow into the low stress zone and overlap with the height initiated from the low stress interval, as shown in FIG. 3. Two possibilities exist as (*a*) and (*b*) in FIG. 3 and are considered below:

c1) If the height of the low stress interval grows into and covers the high stress interval, use one fracture for the entire payzone. As shown in FIG. 3(*a*), the height H2 covers the entire payzone and one fracture Fracture unit 1 associated with H2 is used to treat the entire CP.

c2) If the height from low stress interval does not cover the high stress payzone, use two fractures, one from the low stress interval and the other from the high stress interval, to treat the CP. As shown in FIG. 3(*b*), two fractures Fracture unit 1 and Fracture unit 2, associated with H1 and H2, are used to treat the payzone. (Note: the division of one CP into two Fracture units is for the limited-entry design. A fracture simulation will still use one fracture for the entire CP with two perforation intervals.)

Similarly, for the example in FIG. 2, the height H5 from the low stress interval I5 covers the high stress interval I4; and the height H7 from the low stress interval I7 grows into the high stress interval I6. Both cases are the scenario of the case in FIG. 3(*a*) and hence, only one fracture is used in each case: Fracture unit 3 for CP4 and Fracture unit 4 for CP5.

In summary, the following table shows the relation between fracture, height, and payzones for all CPs for the example in FIG. 2:

| Fractures | Associated Height | Covered Payzones |
|---|---|---|
| Fracture unit 6 | H9 | CP7 |
| Fracture unit 5 | H8 | CP6 |
| Fracture unit 4 | H7 | CP5 |
| Fracture unit 3 | H5 | CP4 |
| Fracture unit 2 | H3 | CP3 |

-continued

| Fractures | Associated Height | Covered Payzones |
|---|---|---|
| Fracture unit 1 | H1 | CP1, 2 |

a. When there are more than two heights overlapping, we can extend the rules described in b and c as follows. Start with the height associated with the lowest stress initiation interval, locate all payzones covered by this height and designate one fracture for all the covered payzones. Next, consider the height associated with the lowest stress initiation interval among the remaining intervals that are not covered by the first height, and locate all payzones covered by this height and designate one fracture for all the covered payzones. Continue this processes until all payzones are covered by fractures.

Figure 4:
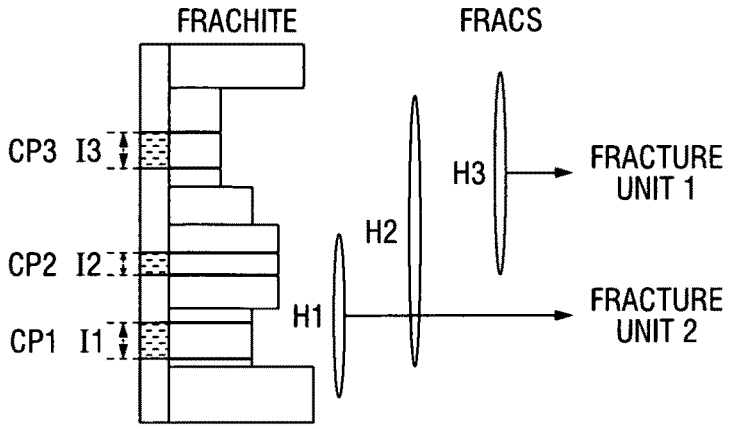
FIG. 4 is a representative view of three overlapping heights with the middle height having the smallest stress.

We use FIG. 4 to illustrate this procedure where three heights are overlapping. First consider the height (H3) associated with the lowest stress interval (I3). Since the height H3 covers another interval (I2) of higher stress, use one fracture (Fracture unit 1) of that height (H3) for these two associated CPs (CP2 and CP3). Next, consider the remaining uncovered CPs (CP1). In this case, there is only one CP (CP1) left. Use one fracture (Fracture unit 2) of this height (H1) for CP1. If there are more than one CPs left (not shown in FIG. 4), repeat the above procedure by checking the height from the interval with the lowest stress among the remaining CPs, until all CPs are covered by fracture.

Figure 5:
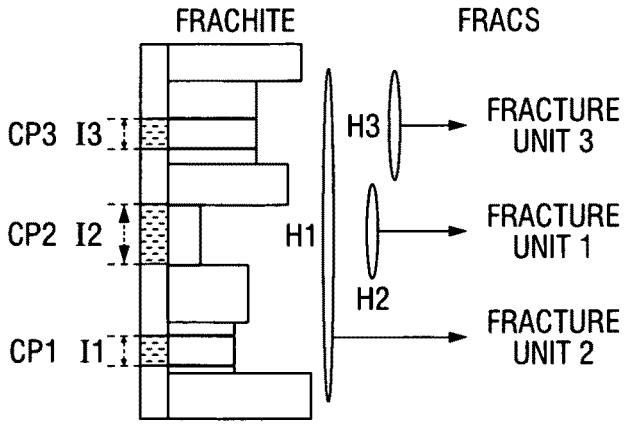
FIG. 5 is an example screen shot of the fracture height and fracture unit determination and the resulting stage design.
Figure 6:
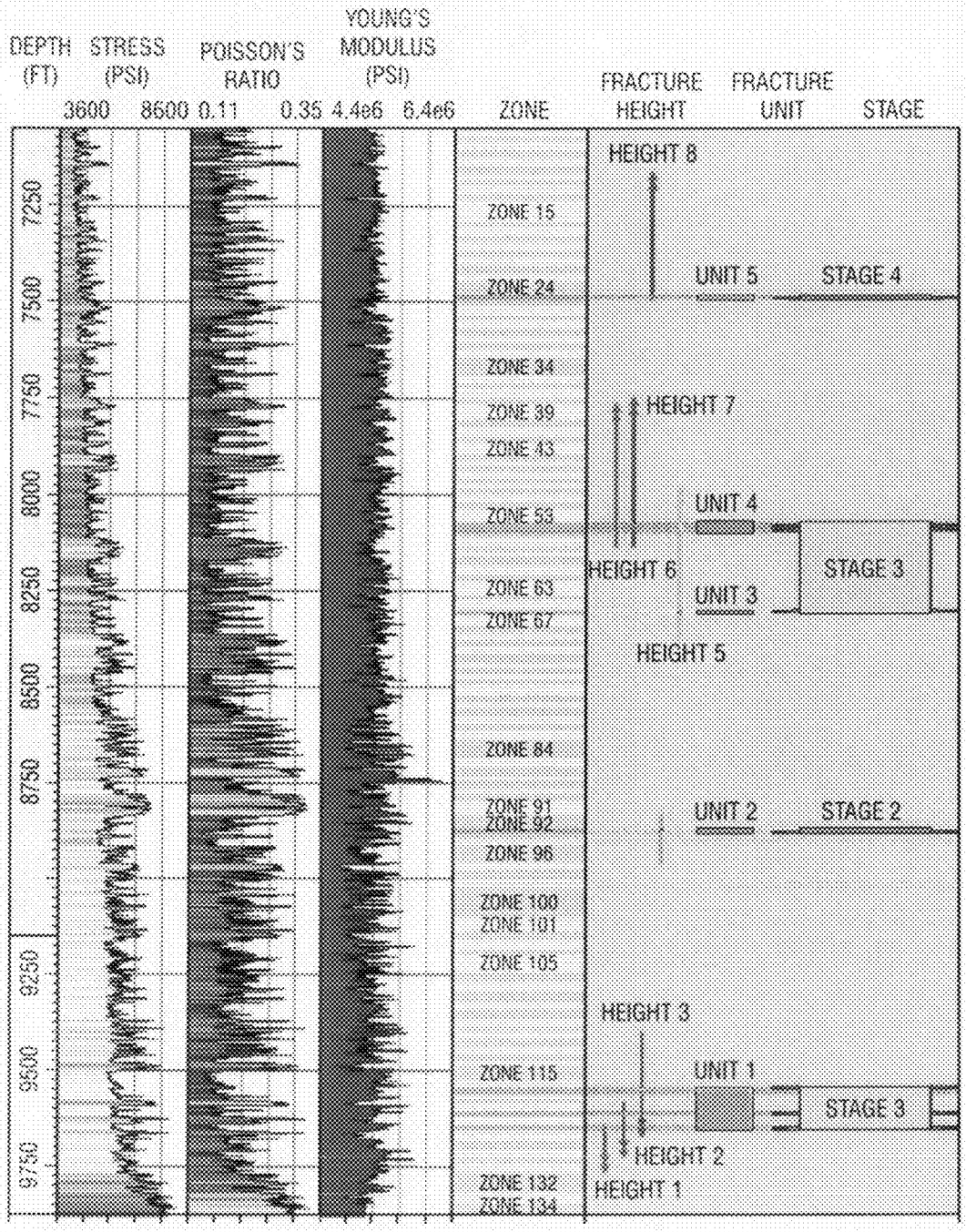
FIG. 6 is a schematic view of mechanical properties and model output.

Another scenario of three heights overlapping is shown in FIG. 5. The height associated with the lowest stress interval I2 is H2 and H2 covers CP2 only. According to the above rule, one fracture (Fracture unit 1) is used for CP2. Among the remaining heights (H1 and H3), H1 is from the lowest stress interval I1. Although H1 covers CP1 and CP3, there is Fracture unit 1 between CP1 and CP3. In this case, a fracture initiated from Il is not likely pass a concurrent fracture (Fracture unit 1) initiated from a lower stress interval to reach CP3. Therefore, we use Fracture unit 2 for CP1 and a separate Fracture unit 3 for CP3. The general rule for such scenarios is: when searching for possible covered CPs, the range of search is between already selected Fracture units.

b. When there is not enough stress barriers to limit fracture height growth, other rules are required to select fractures. For example, a height limit, e.g., 300 ft, can be specified by the user as the maximum gross height, and only the CPs covered within this height limit are treated by one fracture.

The Fracture units may need to be re-numbered sequentially from bottom up after this step is completed.

6. Stages

The next step is to determine how many fractures (Fracture units) are grouped into one treatment stage. Starting from the well bottom, determine the number of Fracture units that can be treated in one stage based on the available pump rate Q (bbl) and pump rate per unit height q (bbl/ft) required for fracturing in a particular formation. Both the available pump rate Q and the pump rate per unit height q are specified by the user. The pump rate for each Fracture unit is the product of the pump rate per unit height q times the fracture height or the payzone height. When the sum of the required pump rates from a number of Fracture units reaches the available pump rate, these Fracture units are grouped into one stage.

If using fracture height to determine pump rate, we need to consider overlapping heights. When Fracture units have overlap heights, only one of the overlap parts is used in the flow rate calculation. For the example in FIG. 2, the heights H8 (Fracture unit 5) and H9 (Fracture unit 6) are overlapping. The part of H8 below H9 is used in the flow rate calculation. The reason is in a vertical or slightly deviated well, the height growth of one fracture is likely to be hindered by the height growth of the fractures immediately below or above in an actual treatment. The amount of overlap will be small when two fractures are growing simultaneously due to the mechanical interaction between them. If using the height of the payzones in the flow rate calculation, there is no overlap issue. This process is repeated upwards along the wellbore until all Fracture units are grouped into stages.

The stage determination can also be based on other criteria, such as based on maximum gross height, minimum distance between the stages, and minimum net height.

When there is more than one fracture in a stage, limited entry perforating may be needed when the stress differences between the fractures are large. For each stage, if the stress difference between the Fracture units is larger than a user specified value, use the limited entry design algorithm to determine the number of perforation holes for each fracture. The limited entry design algorithm is based on the stresses of Fracture units. The stress of a Fracture unit is the stress of its initiation interval. In the example of FIG. 2, for Stage 1, the stress of Fracture unit 1 is the stress in the interval Il, the stress of Fracture unit 2 is the stress of the interval I3. If the difference is less than the specified value, no limited entry is required and the number of perforation holes is determined by other rules that may be used to minimizing perforation pressure drop during treatment or perforation skin during production.

EXAMPLE

The method has been implemented in a hydraulic fracturing treatment design software package. FIG. 5 is an example screen shot of the fracture height and fracture unit determination and the stage design from the software. The required formation mechanical properties of stress, Young's modulus and Poisson's ratio are determined from well logs as shown by the log graphs in FIG. 5. The zones are determined from petrophysical properties and mechanical properties. The payzones are marked by a green color. The fracture height for each payzone is calculated by the procedure described in Step 3 using the mechanical properties from the logs and a BHTP value, which is determined by the user as the payzone stress plus 500 psi (net pressure of hydraulic fracturing). The fracture heights are shown by the vertical bars. The fracture units are then determined by the procedure described in Step 4 of the method. The stages are then determined by the procedure described in Step 5. As can been seen in FIG. 5, one fracture unit may include one or more payzones and one stage may include one or more fracture units. In this way, the entire formation is treated with a minimum number of stages that generate fractures covering all payzones.

The particular embodiments disclosed above are illustrative only, as the invention may be modified and practiced in different but equivalent manners apparent to those skilled in the art having the benefit of the teachings herein. Furthermore, no limitations are intended to the details herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for treating a subterranean formation, comprising:

measuring mechanical properties of a formation comprising Young's modulus, Poisson's ratio, and in-situ stress;

determining formation fracture height based on the measured mechanical properties;

estimating number and location of hydraulic fractures based on the determined formation fracture height;

identifying hydraulic fracturing treatment stages based on the estimated number and location of hydraulic fractures, and no or minimal overlapping of hydraulic fractures in each of the stages; and fracturing the formation by performing hydraulic fracturing treatments over multiple layers in the identified stages.

2. The method of claim 1, wherein the identifying the stages comprises grouping the fractures together based on available pumping capacity for each treatment stage.

3. The method of claim 1, wherein the identifying the stages comprises determining the number of stages required to treat the entire well.

4. The method of claim 1, wherein the fracturing comprises fracturing the treatment stages.

5. The method of claim 1, further comprising using a computer to perform the determining, estimating, and identifying.

6. The method of claim 1, wherein the performing hydraulic fracturing treatments comprises introducing fluid to the formation at a pressure equal to or higher than the pressure needed to fracture the formation.

7. The method of claim 1, wherein the performing hydraulic fracturing treatments comprise introducing a fluid selected from the group consisting of water, hydrocarbons, acid, gases, or a combination thereof.

8. The method of claim 7, wherein the fluid further comprises proppant.

9. The method of claim 1, wherein identifying comprises identifying a minimum number of stages, each of the stages having at least one payzone and wherein fracturing comprises generating fractures that cover all payzones in the identified stages.

10. A method for treating a subterranean formation, comprising:

measuring mechanical properties of a formation comprising Young's modulus, Poisson's ratio, and in-situ stress;

determining a target zone based on the measured mechanical properties;

estimating number and location of hydraulic fractures based on the determined target zone;

identifying stages based on the estimated number and location of hydraulic fractures, and no or minimal overlapping of hydraulic fractures in each of the stages; and fracturing the formation by performing hydraulic fracturing treatments over multiple layers in the identified stages.

11. The method of claim 10, wherein the identifying the stages comprises grouping the zones together based on available pumping capacity for each treatment stage.

12. The method of claim 10, wherein the identifying the stages comprises determining the number of stages required to treat the entire well.

13. The method of claim 10, wherein the fracturing comprises fracturing the treatment stages.

14. The method of claim 10, further comprising using a computer to perform the determining, estimating, and identifying.

15. The method of claim 10, wherein the performing hydraulic fracturing treatments comprises introducing fluid to the formation at a pressure equal to or higher than the pressure needed to fracture the formation.

16. The method of claim 10, wherein the performing hydraulic fracturing treatments comprise introducing a fluid selected from the group consisting of water, hydrocarbons, gases, or a combination thereof.

17. The method of claim 16, wherein the fluid further comprises proppant.

18. The method of claim 1, further comprising designing a hydraulic treatment based on the measured mechanical properties, the determined formation fracture height, and the estimated number and location of hydraulic fractures and wherein performing comprises performing the hydraulic treatment based on the hydraulic treatment design.

19. The method of claim 10, further comprising designing a hydraulic treatment based on the measured mechanical properties, the determined formation fracture height, and the estimated number and location of hydraulic fractures and wherein performing comprises performing the hydraulic treatment based on the hydraulic treatment design.

20. The method of claim 10, wherein identifying comprises identifying a minimum number of stages, each of the stages having at least one payzone and wherein fracturing comprises generating fractures that cover all payzones in the identified stages.

* * * * *